US005879090A

United States Patent [19]

Hoyt et al.

[11] Patent Number: 5,879,090

[45] Date of Patent: Mar. 9, 1999

[54] RECEIPT PRINTING, STORAGE AND DISCHARGING MECHANISM

[75] Inventors: Robert Alexander Hoyt, Riverton; Anthony Ross Hoyt, Lander, both of Wyo.

[73] Assignee: Axiohm IPB Inc., Ithaca, N.Y.

[21] Appl. No.: 965,710

[22] Filed: Nov. 7, 1997

[51] Int. Cl.[6] ..... B65H 18/08

[52] U.S. Cl. ..... 400/578; 242/535.1

[58] Field of Search ..... 400/584, 585, 400/585.1, 586, 587, 588, 589, 594, 594.1, 605, 606, 613, 614, 614.1; 242/535.1; 101/288

[56] References Cited

U.S. PATENT DOCUMENTS 4,218,032 8/1980 Nagel et al. ..... 242/72.1
4,494,706 1/1985 Becherer et al. ..... 242/65
4,504,026 3/1985 Serizawa et al. ..... 242/71.1
4,784,345 11/1988 Romanowski et al. ..... 242/66

*Primary Examiner*—Ren Yan
*Assistant Examiner*—Dave A. Ghatt
*Attorney, Agent, or Firm*—Salzman & Levy

[57] ABSTRACT

A receipt storage and presenting device is described. The device allows for the storage of various media, such as receipts, slips, forms, labels, tickets, tags, etc. The receipts are introduced into the device by an adjacently disposed printer. The web of the receipt enters the storage and presenting device and is stored within a rib-cage mandrel in an overflow bucket. The device is able to store various lengths of the media up to about twenty feet. The device is then caused to rotate through an angle transverse of the printer discharge direction, which angle is preferably ninety degrees.

21 Claims, 8 Drawing Sheets

RECEIPT PRINTING, STORAGE AND DISCHARGING MECHANISM

FIELD OF THE INVENTION

This invention relates to receipt printing and handling devices and, more particularly, to a receipt printing, storage and presenting mechanism for printing a plurality of transactions upon a continuous web, temporarily storing the receipt web, and thereafter discharging the receipt web at an angle to the normal discharge direction.

BACKGROUND OF THE INVENTION

Retail establishments usually print receipts of the sales transactions upon a supply roll of paper. Very often, a plurality of transactions causes the printing of a lengthy receipt document. The long document presents an unwieldy and unmanageable web that is both unsightly and cumbersome to handle. The lengthy receipt web often drapes awkwardly from the print register, interfering with the entering of additional transactions and summing of the final receipt total.

It would be desirable to provide a means by which the lengthy web can be temporarily contained until the completion of printing and cutting of the receipt.

It would also be advantageous to provide a device in which a long receipt, multiple tickets, labels, forms, etc., can be confined or contained (i.e., "buffered") before presentation.

It would additionally be a benefit to provide a mechanism wherein a lengthy receipt can be temporarily stored and thereafter discharged at a right angle to the normal discharge direction, so as not to interfere with the keyboard or face (display) of the register.

The present invention seeks to provide a device that captures and temporarily stores a lengthy receipt web, as the transactions are printed and totalled, and the web is cut. The device then rotates through an angle of between approximately 0 to 90 degrees (preferably 90 degrees) from the normal web discharge direction, and issues the receipt. The apparatus may be oriented to allow rotation to the left or to the right, providing a presentation field of 180 degrees. In this manner, the front of a register is not encumbered by a long, suspended, receipt web.

SUMMARY OF THE INVENTION

In accordance with the present invention, there is provided a presenting mechanism that stores and then discharges a printed receipt, label, ticket, or form at an angle to the issuing direction. The mechanism comprises an overflow bucket, of generally oval shape, that is disposed adjacent the exit slot of a receipt printer. The overflow bucket is mounted upon a rotatable assembly. The receipt is dispersed as a continuous web from the exit slot of the receipt printer. It then enters the overflow bucket through an entrance guide. A sensor disposed adjacent the entrance guide senses the web of paper and triggers a motor that drives a pair of feed rollers connected thereto by a gear train. The same sensor is used to detect the trailing edge of the receipt, in order to detect jams as well as to determine that the receipt has been successfully discharged. The feed rollers push the paper web onto a rib-cage mandrel disposed in the overflow bucket. The rib-cage mandrel supports the paper as it is stored within the bucket, and allows the web to flow smoothly thereupon. Upon discharge from the overflow bucket, the feed rollers reverse direction and push the paper back out through the entrance guide. The feed rollers are mounted on a gear plate that rotates and causes the discharge of the paper at a second position, disposed above the entrance position. In addition, the rotatable assembly housing the overflow bucket is itself caused to be rotated at right angles to the direction in which the receipt is discharged from the printer. In this manner, the receipt web is discharged at a high position and at right angles to the entrance position.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a receipt storage and presenting device. The device allows for the storage of various media, such as receipts, slips, forms, labels, tickets, tags, etc. The receipts are introduced into the device by an adjacently disposed printer. The web of the receipt enters the storage and presenting device and is stored within a rib-cage mandrel. The rib-cage mandrel also functions as a support for receiving media material (i.e., receipt). The device can store various lengths of the media up to about twenty feet. The device is then caused to rotate through an angle transverse of the printer discharge direction, which angle is preferably ninety degrees. For the purposes of brevity and clarity, like elements and components will bear the same numbering and designation throughout the figures.

Figure 1:
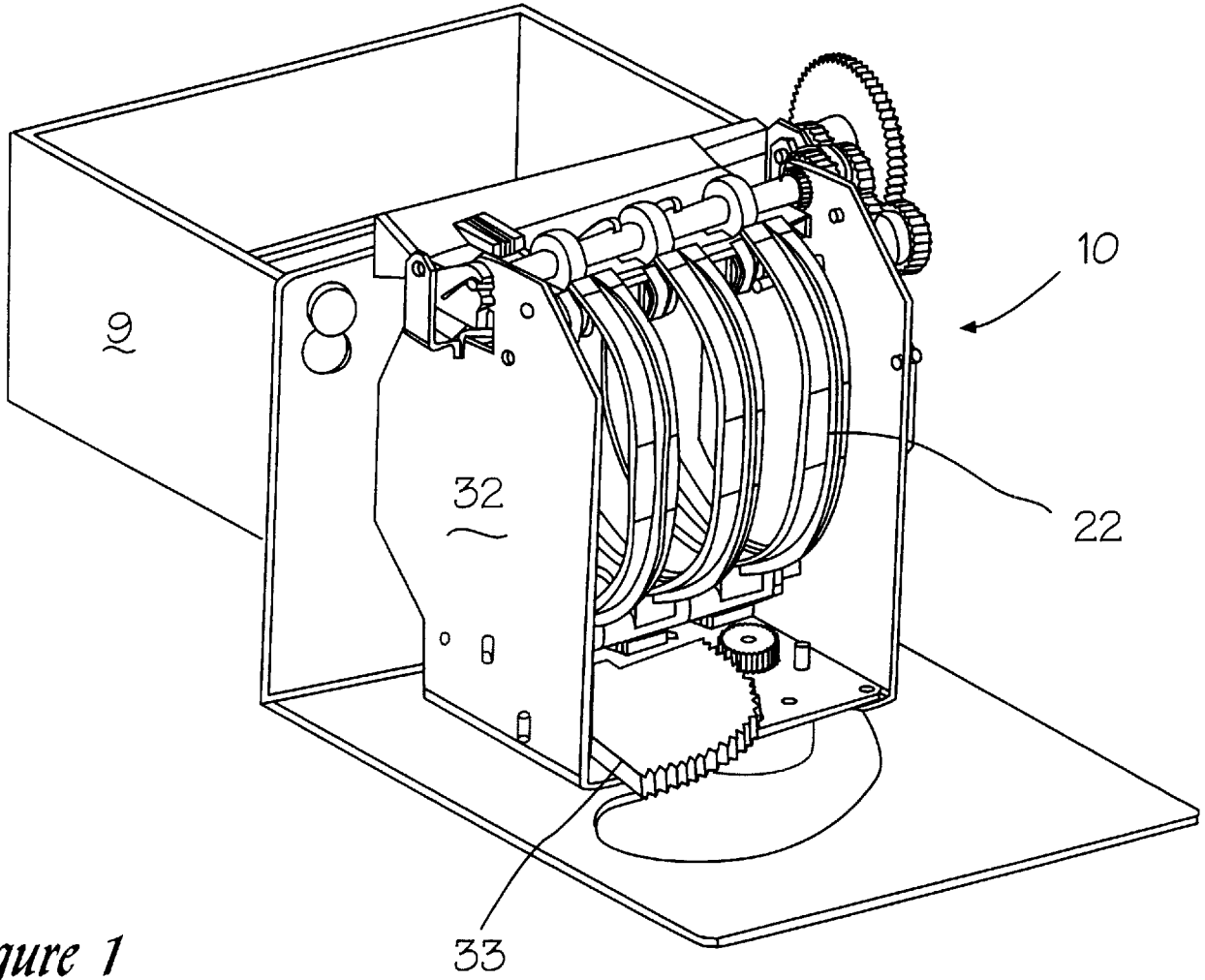
FIG. 1 is a perspective view of the receipt storage and presenter device of the present invention and a printer associated therewith.

Now referring to FIG. 1, a perspective view of the receipt storage and presenter device 10 and associated printer 9 are shown.

Figure 2A:
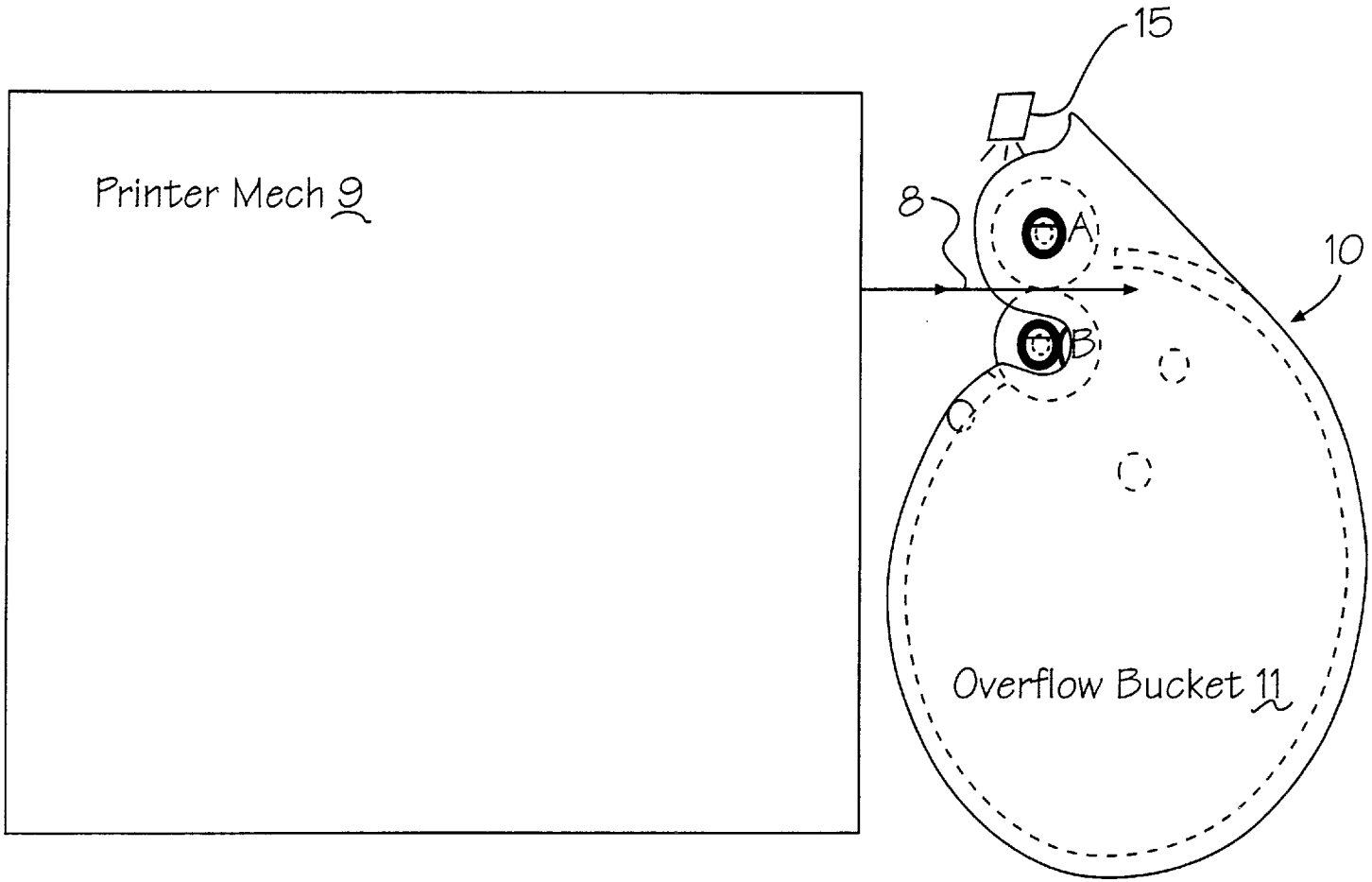
FIG. 2*a* illustrates a schematic side view of the receipt storage and presenter device of the invention receiving a receipt web from a typical printing mechanism at a first receipt receiving position.
Figure 5A:
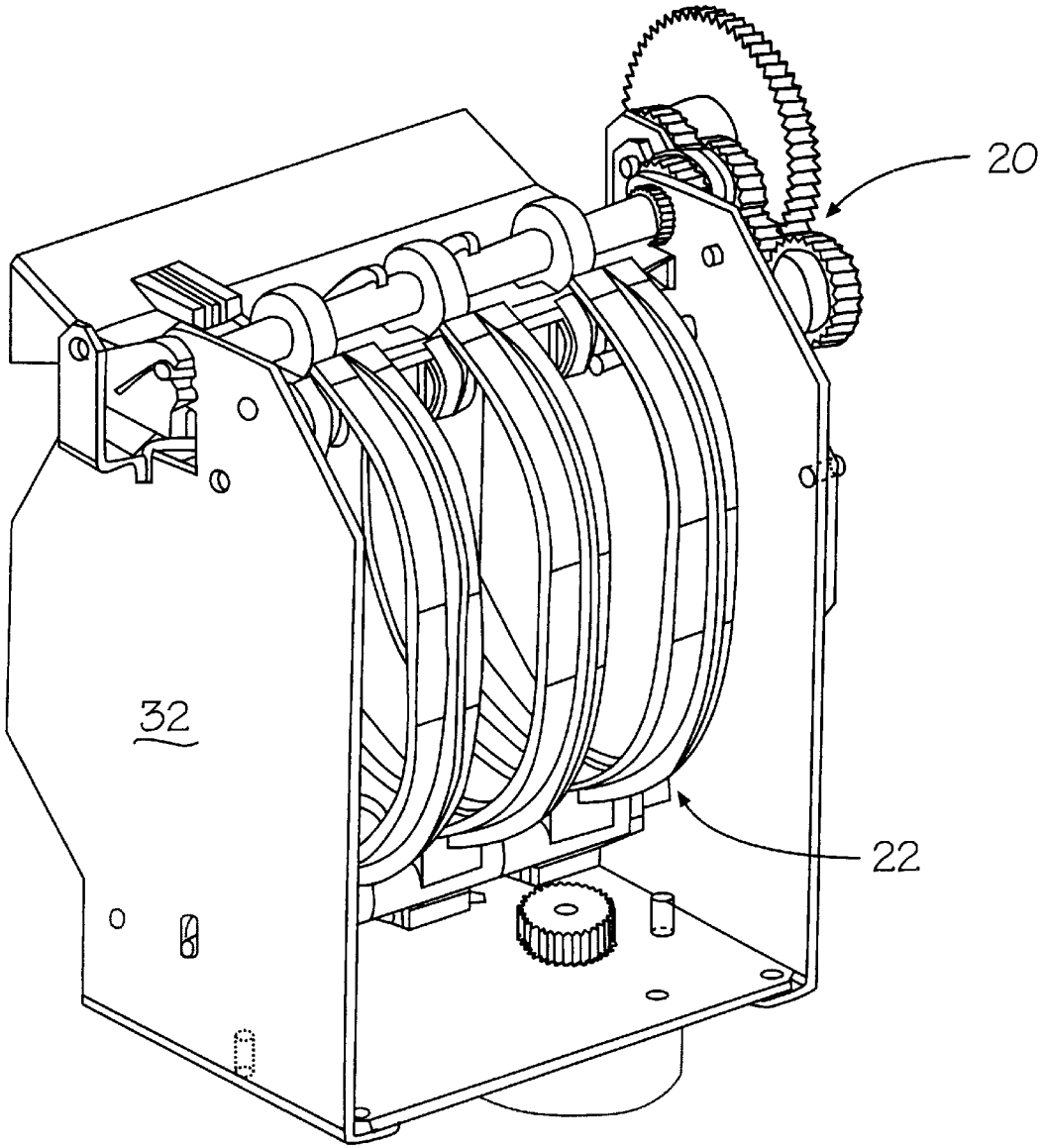
FIG. 5*a* depicts an enlarged view of the storage and presenter device of FIG. 1.
Figure 5B:
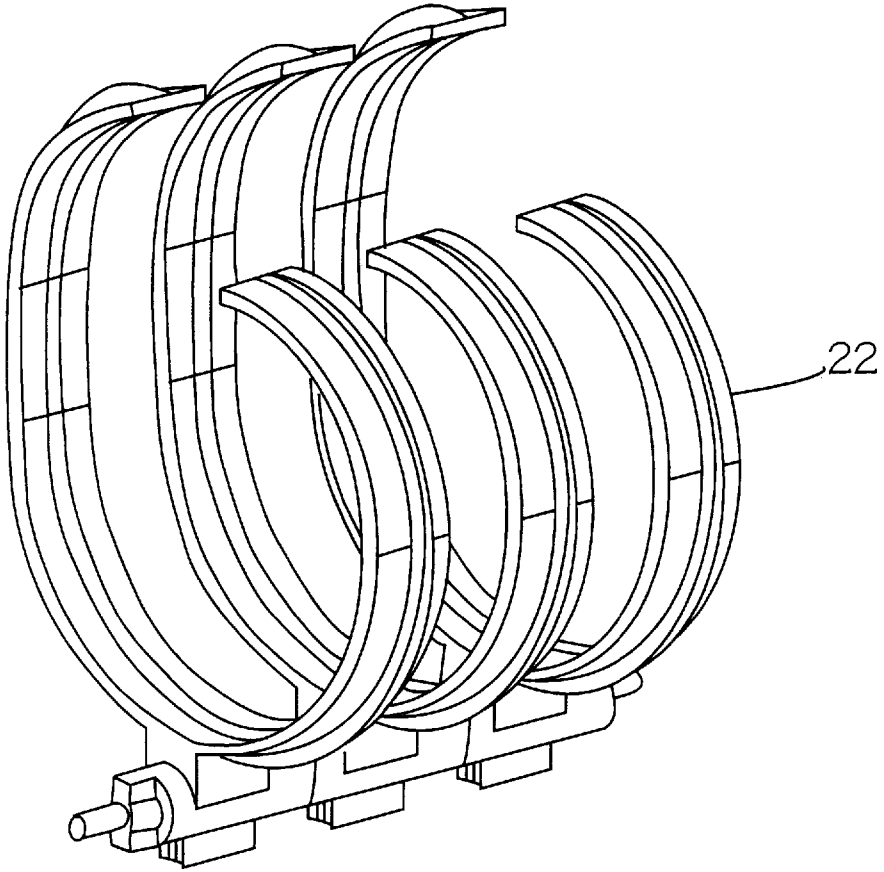
FIG. 5*b* is an isolated, perspective view of the rib-cage mandrel assembly depicted in FIGS. 1 and 5.
Figure 6:
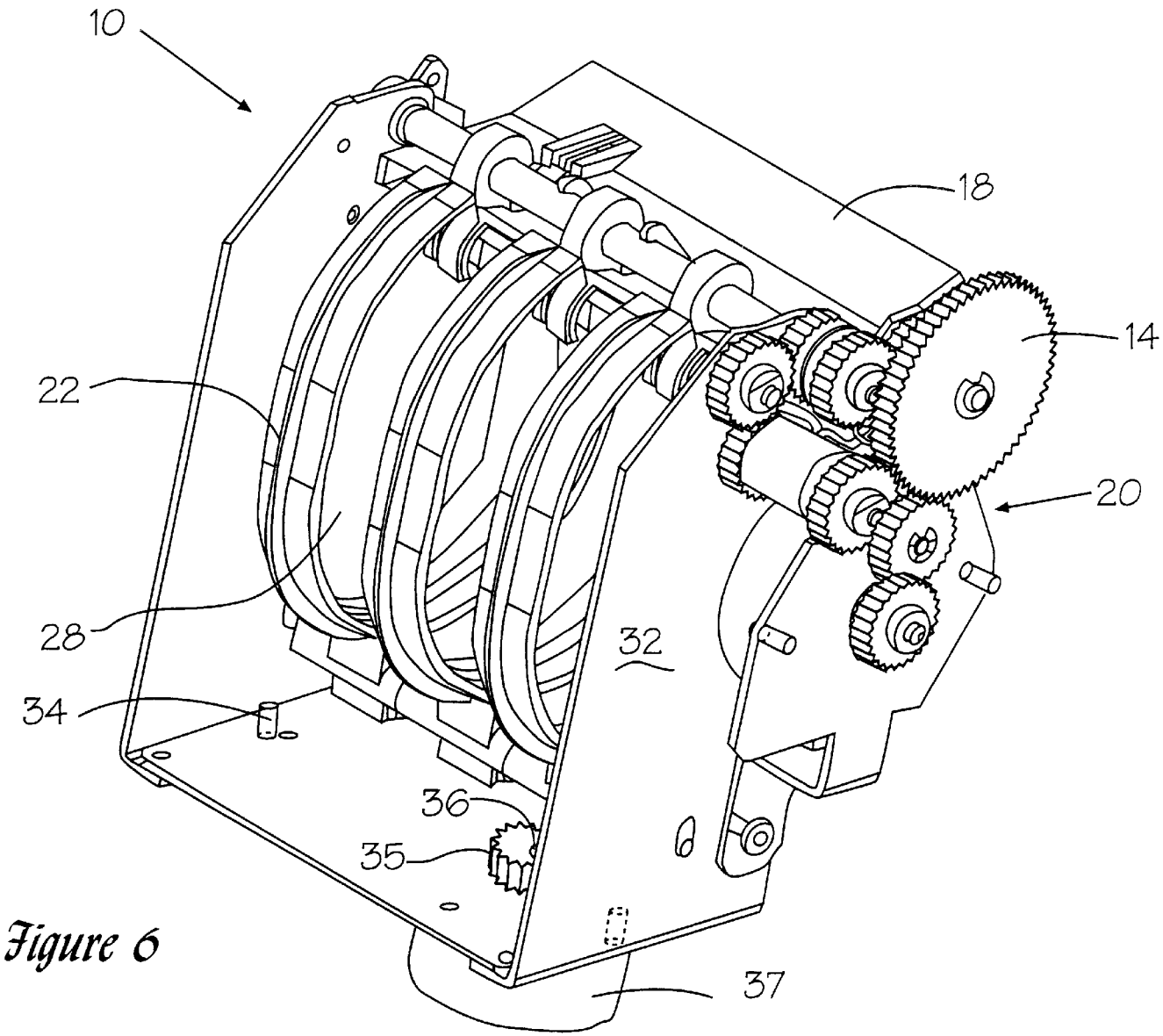
FIG. 6 illustrates another perspective view of the storage and presenter device of FIG. 1.

Now referring to FIG. 2*a*, a schematic side view of a printer mechanism 9 is illustrated. The printer 9 is shown discharging a receipt (arrows 8) to the storage and presenting device 10 of this invention. The device 10 has an overflow bucket 11, which contains two feed rollers "A" and "B", respectively, that drive the receipt 8 into the overflow bucket 11. The feed rollers "A" and "B" are in pressure contact with each other, and are driven by a gear train 20 which is subsequently attached to and driven by a motor (not shown), described in greater detail hereinbelow with respect to FIGS. 3 through 6. The slip or web representing the receipt 8 is discharged by printer 9 into the nip of rollers "A" and "B", and is then wound within a rib-cage mandrel 22 disposed within the overflow bucket 11, as shown in FIGS. 1, 5*a* and 6. Rib-cage mandrel 22, functioning as storage and support, is shown in greater detail in FIG. 5*b*. A sensor 15, disposed in front of rollers "A" and "B", senses the presence of the receipt 8 as it enters device 10, and generates a signal to actuate the motor (not shown) into driving gear train 20, and hence rollers "A" and "B".

Figure 2B:
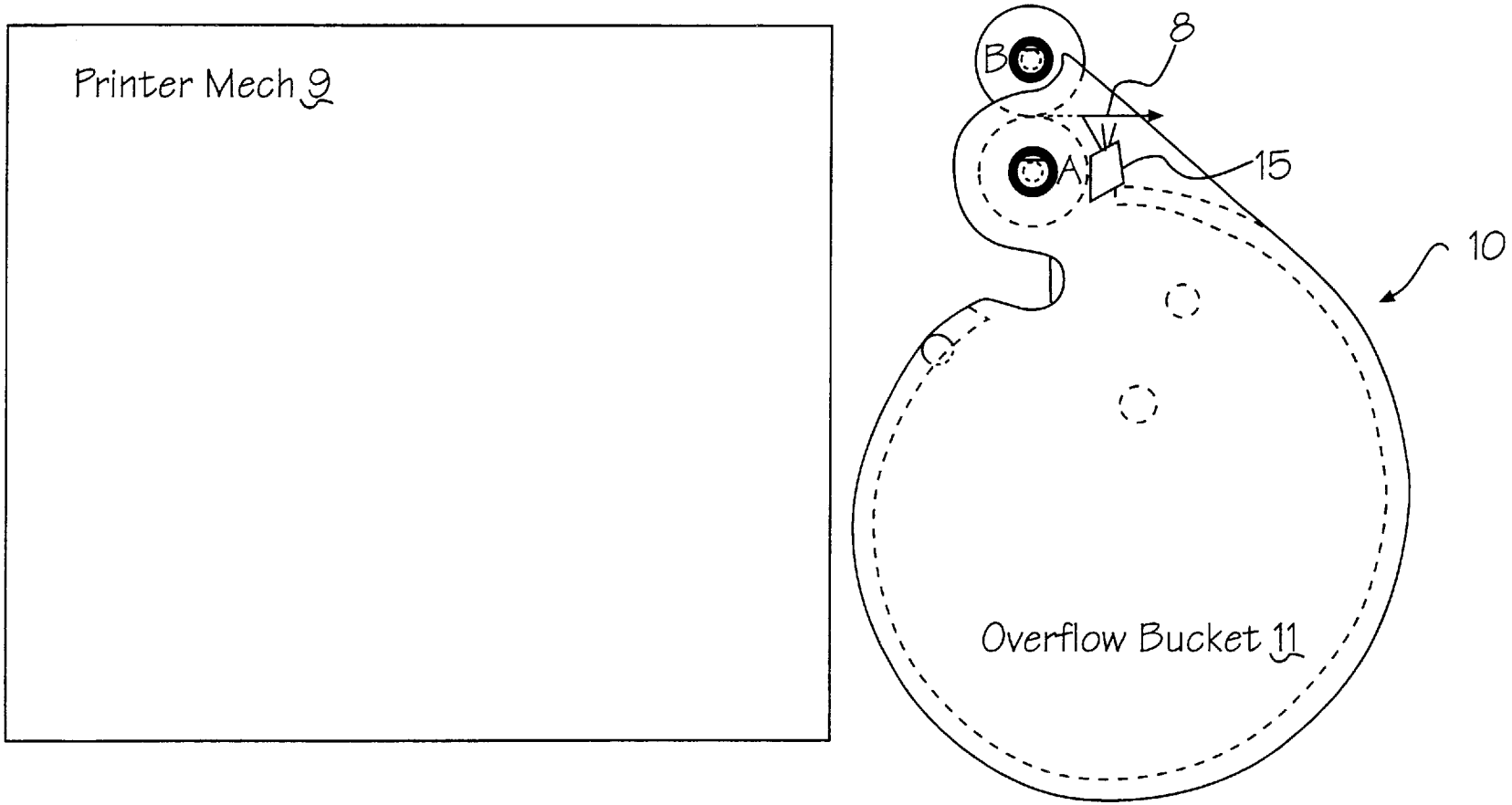
FIG. 2*b* depicts the schematic side view of the receipt storage and presenter device of FIG. 2*a*, with the drive rollers reversed, and the receipt web being presented from the storage and presenter device at a second position disposed above the first receiving position.

Referring to FIG. 2*b*, the receipt 8 is shown being presented (discharged) from the storage and presenting device 10 after having been stored therein. It will be observed that rollers "A" and "B" have switched positions. That is, roller "B" is now disposed over roller "A".

Figure 3:
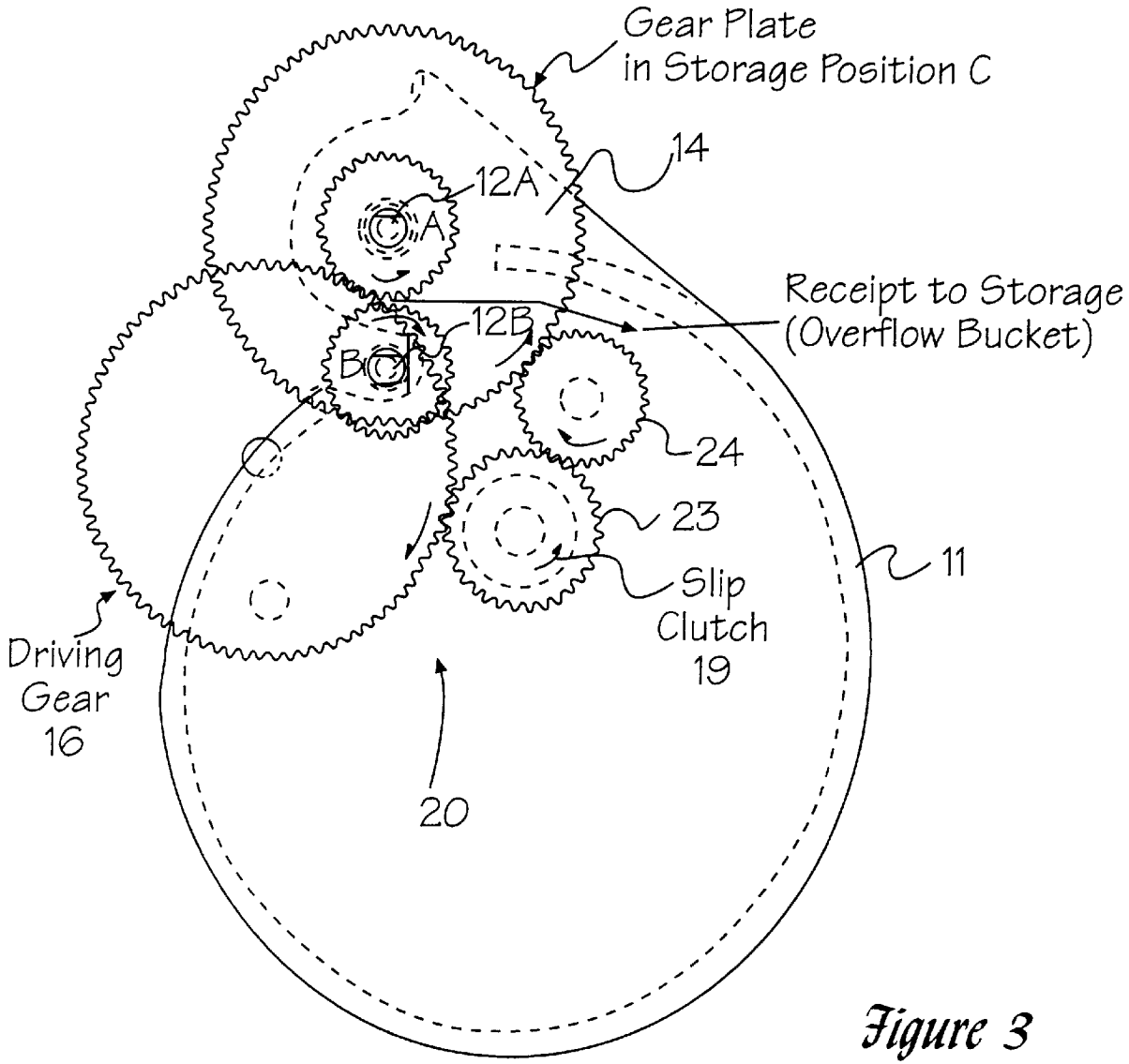
FIG. 3 shows a right side view of the gear drive of the storage and presenter device in said first position, as depicted in FIG. 2*a;*
Figure 4:
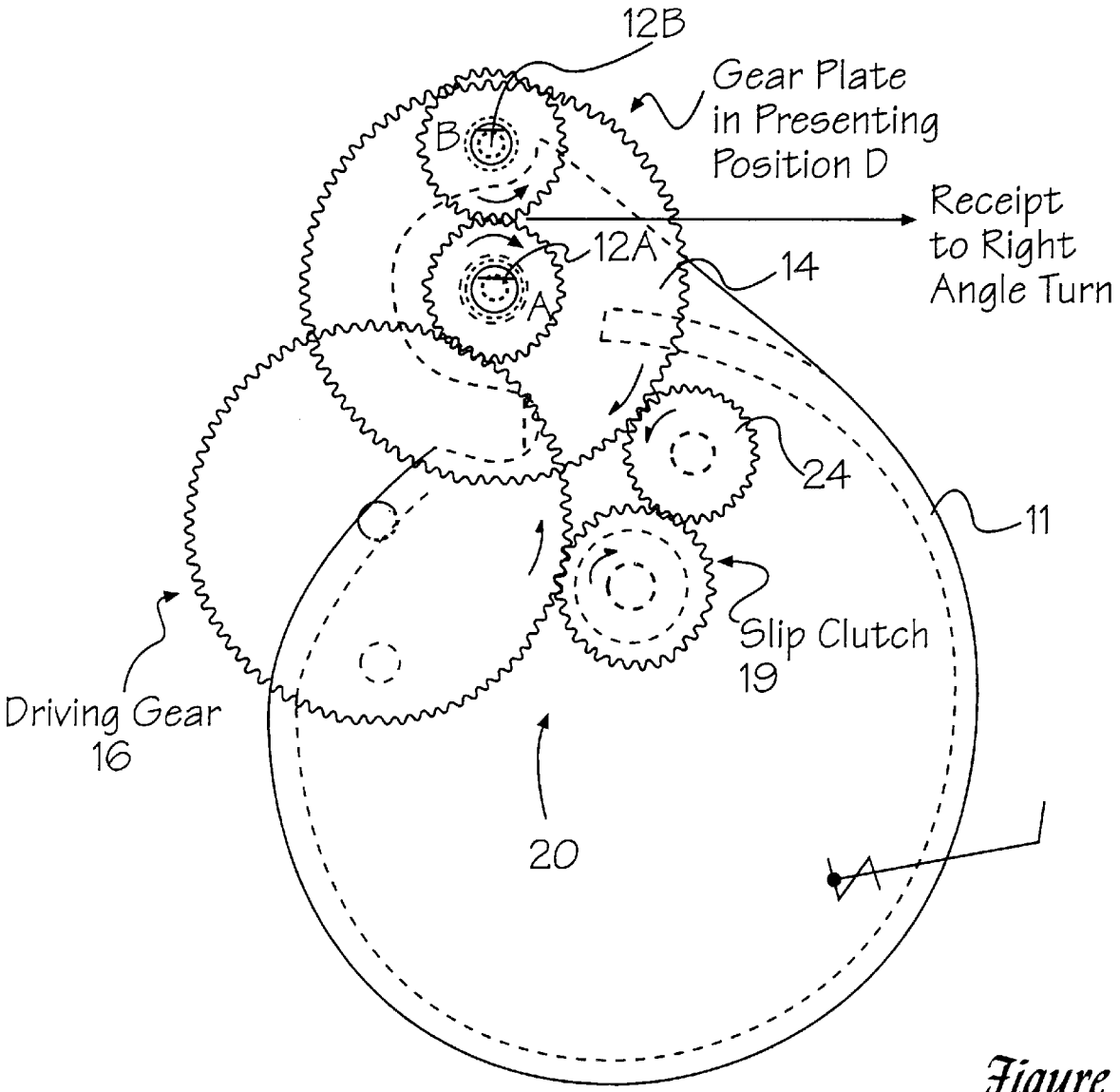
FIG. 4 illustrates a right side view of the gear drive of the storage and presenter device in said second position, as depicted in FIG. 2*b;*

Rollers "A" and "B", respectively, are attached to, and driven by, corresponding gears "A" and "B" (FIGS. 3 and 4). Gears "A" and "B" are mounted for rotation about shafts 12*a* and 12*b*, respectively. The gears "A" and "B" are also mounted on gear plate 14 for revolution about each other, wherein gear "B", and hence roller "B", are driven clockwise about gear "A" and roller "A", respectively, placing gear "B" above gear "A" for the discharge operation; and gear "B" rotates counter-clockwise to its home position to accept the next receipt. The purpose of this revolution is to present the receipt 8 at a greater height than that of the discharge height of printer 9. The higher discharge level from device 10 prevents accidental feeding of the receipt 8 back into printer 9. It will be observed that sensor 15 also shifts its position when gears "A" and "B" reverse positions. This is accomplished by mounting the sensor 15 upon the entrance/exit guide platform 18 (FIG. 6), which is rotatively slaved to the rollers "A" and "B". Thus, sensor 15 can be used, first, to detect the leading edge of the receipt 8 and then to detect the trailing edge thereof.

Referring to FIG. 3, gear plate 14 is shown in the storage position "C", with gear "A" disposed above adjacent gear "B". In this position, the receipt 8 is caused to be fed into the overflow bucket 11.

Referring to FIG. 4, gear plate 14 is depicted in the presenting position "D", with gear "B" disposed above gear "A".

The gears "A" and "B" of gear train 20 are rotatively driven by adjacent driving gear 16, when gear train 20 is in the storage position "C". The driving gear 16 directly engages with gear "B" to drive rollers "A" and "B", respectively, as shown in FIG. 3. In the presenting position "D", as depicted in FIG. 4, the driving gear 16 reverses direction, and also drives gear plate 14, via a slip clutch 19 and intermediate gears 23 and 24. The reversal of the driving gear 16 is accomplished by reversing the driving direction of motor.

Reversal of the motor and the engagement of the slip clutch 19 is triggered by sensor 15, which senses the leading and trailing edges of receipt 8. The receipt 8 is sensed by sensor 15 as it enters the overflow bucket 11. Sensor 15 can be a photosensor that senses the leading edge of the incoming receipt 8, and causes motor to be actuated into driving the gear 16. The motor can be made to reverse its driving direction, when the sensor 15 senses the trailing edge of the receipt web 8. Detecting the trailing edge of receipt 8 is useful for detecting a paper jam or as a signal that the receipt has been discharged to the operator. The sensor 15 sends a signal to reverse the motor and to engage the slip clutch 19 with the intermediate gear drive (gears 23 and 24). Engaging the slip clutch 19 causes the gear plate 14 to rotate, thus reversing the position of the gears "A" and "B". These gears "A" and "B" now revolve to the presenting position "D", as shown in FIGS. 2*b* and 4.

A door, not shown, could be actuated when the entrance guide is rotated to discharge the receipt form, ticket, etc. This door would be closed until the time of receipt discharge, in order to block the fascia entrance to the presenter, preventing foreign objects from being inserted into the presenter.

Referring to FIG. 6, the overflow bin area 28 of storage and presenting device 10 is shown. The overflow bin area 28 allows for multiple presentations. In fact, it should be understood that multiple receipt exit points can be provided, depending on the mounting orientation of the presenter in relation to the print mechanism. For example, the presenter may be assembled in such a manner so as not to include means to store the receipt or web. The receipt, if not taken by operator, could be retracted and fed in a downward direction into a bin or bucket. This would purge the presenter of any web material and allow for the next receipt. A trash bin area can be provided below for receipts that are rejected.

The rollers "A" and "B", the entrance guide 18, and the gear train 20 are all supported upon a rotatable frame 32. Frame 32 is pivotally supported about shaft 34. The shaft 34 is connected to sectional gear 33, (FIG. 1) which is driven by spur gear 35. The spur gear 35 is rotatively driven by a drive motor 37 via a connecting shaft 36. Pivoting the frame 32 allows receipt 8 to be discharged at an angle with respect to the incoming receipt direction, as shown in FIG. 2*a*. The preferred angle is ninety degrees, but the frame 32 can be pivotally directed about any angle from zero to ninety degrees. Moreover, when the apparatus is adapted to rotate up to 90 degrees to the left and up to 90 degrees to the right, a presentation field of 180 degrees is obtained. The sensor 15 actuates motor 37, when the trailing edge of the web is sensed.

It should be understood that the presenter can be constructed in such a manner as to allow for varying widths of media. This can be done with a modular, building block approach, by which some parts and assemblies are used to build various width presenters. One presenter could also be constructed and used with two different print mechanisms, or two similar mechanisms to alternately present different media, (e.g., two color receipts from one unit and tickets or coupons from the other).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A media storage and presenting device, comprising:

support means for receiving media material;

a pair of feed rollers for feeding the media material along a feed direction to said support means;

rotative drive means for driving said pair of feed rollers;

a gear train disposed between said pair of feed rollers and said rotative drive means for rotatively moving said feed rollers from a media receiving position to a media presenting position; and pivotable drive means attached to said support means for pivoting said pair of feed rollers at an angle with respect to said feed direction.

2. The media storage and presenting device in accordance with claim 1, further comprising a sensor disposed adjacent said pair of feed rollers for sensing a leading and trailing edge of said media material in order to actuate both said rotative and pivotable drive means.

3. The media storage and presenting device in accordance with claim 2, further comprising entrance guide means disposed adjacent said pair of feed rollers for supporting said sensor.

4. The media storage and presenting device in accordance with claim 1, wherein said support means comprises a rib-cage mandrel.

5. The media storage and presenting device in accordance with claim 1, wherein said gear train further comprises a gear plate for supporting said pair of rollers for revolving motion and a slip clutch for engaging said gear plate with said rotative drive means for changing a height position of said pair of feed rollers.

6. The media storage and presenting device in accordance with claim 1, wherein said pivotable drive means can pivot said support means from approximately zero to ninety degrees with respect to said feed direction.

7. The media storage and presenting device in accordance with claim 1, in combination with printing means, wherein said media is discharged from said printing means and introduced into said media storage and presenting device.

8. A media storage and presenting device, comprising:

support means for receiving media material;

at least one feed roller for feeding the media material along a feed direction to said support means;

a gear train for rotatively moving said at least one feed roller from a media receiving position to a media presenting position; and media buffer means for temporarily containing said media prior to the discharging thereof.

9. The media storage and presenting device in accordance with claim 8, wherein said media buffer means comprises a rib-cage mandrel in which said media is wrapped and stored.

10. The media storage and presenting device in accordance with claim 8, further comprising entrance guide means disposed adjacent said at least one feed roller for supporting a sensor, said sensor being capable of sensing an edge of said media material.

11. The media storage and presenting device in accordance with claim 8, wherein said at least one feed roller comprises a pair of feed rollers.

12. The media storage and presenting device in accordance with claim 11, wherein said gear train further comprises a gear plate for supporting said pair of feed rollers for revolving motion and a slip clutch for engaging said gear plate with said rotative drive means for changing a height position of said at least one feed roller.

13. The media storage and presenting device in accordance with claim 8, further comprising pivotable drive means operatively connected to said support means for pivoting said support means from approximately 0 to 180 degrees with respect to said feed direction.

14. A media storage and presenting device, comprising:

support means for receiving media material;

a pair of feed rollers for feeding the media material along a feed direction to said support means;

rotative drive means for driving said pair of feed rollers;

a gear train disposed between said pair of feed rollers and said rotative drive means for rotatively moving said feed rollers from a media receiving position to a media presenting position;

pivotable drive means attached to said support means for pivoting said pair of feed rollers at an angle with respect to said feed direction; and sensing means for sensing a leading and trailing edge of said media material in order to actuate both said rotative and pivotable drive means.

15. The media storage and presenting device in accordance with claim 14, further comprising entrance guide means for supporting said sensing means.

16. The media storage and presenting device in accordance with claim 14, wherein said support means comprises a rib-cage mandrel.

17. The media storage and presenting device in accordance with claim 16, wherein said media is wrapped within said rib-cage mandrel prior to the discharge thereof.

18. The media storage and presenting device in accordance with claim 14, wherein said gear train further comprises a gear plate for supporting said pair of rollers for revolving motion and a slip clutch for engaging said gear plate with said rotative drive means for changing a height position of said pair of feed rollers.

19. The media storage and presenting device in accordance with claim 14, further comprising a motor for pivotally driving said pivotable drive means.

20. The media storage and presenting device in accordance with claim 14, in combination with printing means, wherein said media is discharged from said printing means and introduced into said media storage and presenting device.

21. A media storage and presenting device, comprising:

support means for receiving media material;

at least one feed roller for feeding the media material along a first feed direction to said support means;

means for rotatively moving said at least one feed roller from a media receiving position to a media presenting position; and drive means for driving said at least one feed roller and for pivoting said at least one feed roller at an angle with respect to said first feed direction, so that said media material can be discharged in a second feed direction different from said first feed direction.

* * * * *